United States Patent [19]

Ilzig

[11] 4,032,771

[45] June 28, 1977

[54] SURGICAL OPERATING LAMP

[75] Inventor: Karl F. Ilzig, Hanau, Germany

[73] Assignee: Original Hanau Quarzlampen GmbH, Hanau, Germany

[22] Filed: Apr. 24, 1975

[21] Appl. No.: 571,321

Related U.S. Application Data

[63] Continuation of Ser. No. 435,796, Jan. 23, 1974.

[30] Foreign Application Priority Data

Feb. 6, 1973 Germany ..... 2305664

[52] U.S. Cl. ..... 240/1.4; 240/47

[51] Int. Cl.[2] ..... A61G 13/00

[58] Field of Search ..... 240/1.4, 41.15, 47

[56] References Cited

UNITED STATES PATENTS

| | | | |
|---|---|---|---|
| 2,878,371 | 3/1959 | Hanlin | 240/47 |
| 3,010,013 | 11/1961 | Gunther et al. | 240/1.4 |
| 3,119,567 | 6/1964 | Schwartz | 240/47 |
| 3,255,342 | 6/1966 | Seitz et al. | 240/1.4 |
| 3,609,335 | 9/1971 | Kelly | 240/1.4 |

*Primary Examiner*—Ulysses Weldon

*Attorney, Agent, or Firm*—Sughrue, Rothwell, Mion, Zinn & Macpeak

[57] ABSTRACT

The present invention relates to a surgical operating lamp with mainly cold light radiation, whereby the infrared part of the light radiation from a light source is reflected by means of a concave cold light reflector and by an infrared reflector in the lamp area which reflects the infrared rays toward a heat absorbing body surrounding the lamp body. An outer bell, surrounds said heat absorbing body and forms a space therebetween to allow the passage of air therethrough to facilitate the cooling of the heat absorbing body.

7 Claims, 3 Drawing Figures

SURGICAL OPERATING LAMP

This is a continuation of application Ser. No. 435,796 filed Jan. 23, 1974.

BACKGROUND OF THE INVENTION

In order to obtain a cold light radiation as extensive as possible with surgical operating lamps, it is known to provide means with which the infrared part of the light radiation is reflected from the remaining path of the rays. Thus, for instance, a concave reflector gathering the light rays of a radiation source can be in the form of a cold light mirror permitting passage to the infrared radiation. The remaining infrared part emitted from the front is filtered by means of a filter plate formed as infrared reflector and is reflected into the lamp. Although, indeed, in the case of such surgical operating lamps, the direct light radiation is mostly free of heat radiation, the disadvantage of such lamp is that the whole lighting body is self-heating, as a result of the reflected infrared radiation, and, thereby, acts as a secondary radiator. Besides that, there is a danger of destruction due to overheat. In order to avoid such a disadvantage, it has been recommended to eliminate the arising heat by means of a flow medium forced through the surgical operating lamp. This has, however, the disadvantage that such a surgical operating lamp is expensive as well as complicated and further that additional means of connection are necessary.

SUMMARY OF THE INVENTION

The object of the invention is to provide a surgical operating lamp with which, by means of simple measures, heat disapation is possible in order to avoid an over-heating of the surgical operating lamp. It is thereby important that the surgical operating lamp is independent from additional means of connection and is of uncomplicated construction.

A surgical operating lamp is provided in which the infrared radiations are absorbed by an inner heat absorbing bell around which, at least in the upper area, is mounted an outer bell such that a space is formed between said inner and outer bells. The outer bell is open at the top and bottom to allow the passage of air through said space to facilitate the cooling of the inner bell.

The essential advantage of the surgical operating lamp according to the invention is that the infrared radiation reflected towards the back in the lamp area is absorbed by the inner bell and that the heat is lead off owing to the air flowing from bottom to top through the space between the inner and outer bells. Whereby, it is possible with simple measures to provide a cooling of the surgical operating lamp.

The invention is explained below in more details with reference to the drawings.

DETAILED DESCRIPTION OF A PREFERRED EMBODIMENT

Figure 1:
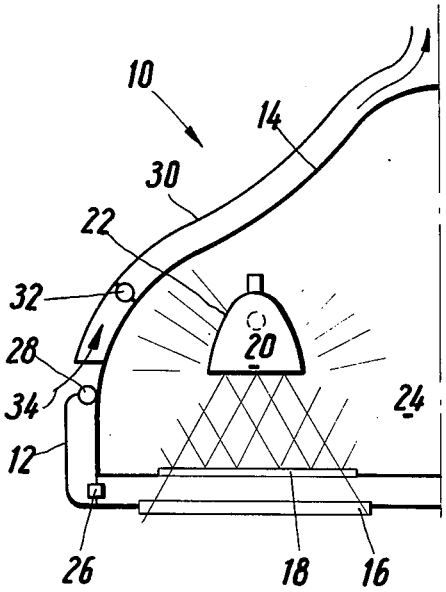
FIG. 1 is a partial sectional view of a first embodiment of a surgical operating lamp according to the present invention, with central chimney outlet.

A surgical operating lamp 10 consists of a lighting body 12, in which, an inner opaque black absorbing bell 14 is supported by means of insulating stays 26 and 28. Stay 28 may also be formed as a detachable fastening link between the lighting body 12 and the absorbing bell 14.

In the lower area of the surgical operating lamp there is a transparent front pane 16 in the lighting body 12 to which an infrared reflector 18 is connected in series in the interior of the surgical operating lamp, said reflector transmitting only the heat-free luminous radiation of a light source 20, which may be a quartz-halogen lamp. The infrared radiation is reflected back into the interior of the surgical operating lamp. The quartz-halogen lamp is disposed in front of a concave, cold light reflector 22. The latter reflects the luminous rays toward front pane 16, but lets through almost without hindrance the heat radiation from the source of the beam reaching the concave reflector 22. The infrared parts radiated to the back as well as to the front are separated from the visible light rays and reflected inside the lamp.

The upper tapered portion of the inner absorbing bell 14 is surrounded by an outer bell 30, which is retained in position on absorbing bell 14 by means of one or more insulating supporting fasteners 32, which serve to support outer bell 30 spaced from inner bell 14 so as to form a chimney 34 extending from the bottom to the top and open at the bottom and at the top. The insulating supporting fastener 32, may be a quick release type fastener to facilitate removal of outer bell 30 from inner bell 14. Of course, it is also possible to make supporting and fastening links separate from each other. Furthermore, if the dead weight of the outer bell 30 is sufficient, a fastening link can be dispensed with.

Figure 2:
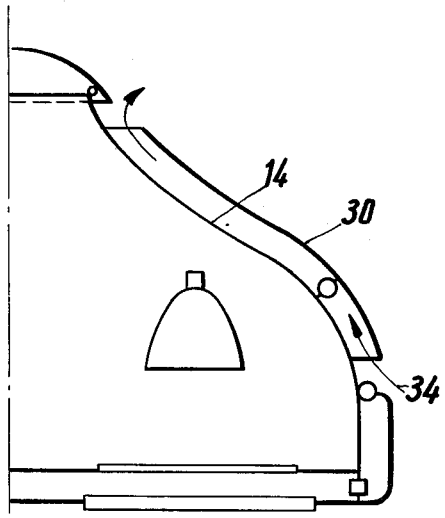
FIG. 2 is a partial sectional view of an alternative embodiment of a surgical operating lamp, according to the present invention.

The lower entrance of the chimney 34 is situated between the upper part of the lighting body 12, and the lower limitation of the outer bell 30, said chimney extending in a nearly constant cross-section along the inner absorbing bell 14 up to its top, where, in a first embodiment shown in FIG. 1, a central chimney outlet is provided. It can also be advantageous to have an annular chimney outlet in accordance with FIG. 2, lying underneath the top of the lamp. Furthermore, it is also possible to execute a slotted chimney outlet, whereby different successive slots result over the circumference of the lamp.

Due to the impact of the infrared radiations upon the inner absorbing bell 14, the latter warms up. As this heat is transferred to the air in the chimney, the air rises thereby generating a circulating air current through the chimney, from the bottom to the top. The ambient air, at first cool, enters at the bottom of the chimney and warms itself up during its passage in the chimney, to come out by the chimney outlet as warm air. Since the outer bell 30 is spaced from the inner absorbing bell 14, it does not warm itself up under the influence of the infrared radiation.

Although under normal operating conditions the heating of the air in the chimney by inner bell 14 provides sufficient air circulation, it is also possible to mount one or more circulation blowers on the lamp structure in order to accelerate and improve the cooling in the area of the chimney. It is further possible to exhaust the warm air towards the top and to remove it from the theatre of operation, so that, even by high radiation output, no perceivable heat in the room occurs.

For the purpose of cleaning the chimney 34 which accumulates dirt particles as a result of the continuous air circulation, it is necessary that the outer bell 30 be removable from inner bell 14. Outer bell 30 can be formed in such manner that it can be removed as a whole from the top. Such an embodiment is in general possible, because the suspension of known surgical operating lamps consists in many cases of a fork catching the lighting body 12 laterally, said fork being in turn fastened to the ceiling or some other supporting frame. However, in case that the surgical operating lamp is fastened in its upper central part, the outer bell 30 can be fabricated in several parts, so that these different parts are removable from the side. As the total weight of the surgical operating lamp is reduced when the outer bell is removed, it can be appropriate in the case of a fork suspension with counter-weight to lock the latter in its position during the cleaning operation.

As a rule, the known surgical operating lamps consist of several radiation units and it is appropriate to provide such a lamp modified according to the invention with different radiation chambers, whereby the individual chambers are separated one from another by intermediate collecting partitions 24. These in turn should be in heat contact with the inner absorbing bell 14, so that the heat caused by the infrared absorption in the intermediate collecting partitions 24 can be carried off. In order to increase the infrared absorption, the intermediate collecting partitions 24, just like the collecting bell 14, can be executed in opaque black. Alternatively the intermediate collecting partitions 24 may be infrared reflectors such that the heat radiation impacting upon them, is reflected against the collecting bell 14. The advantage of such a construction is that the efficiency of the heat elimination does not depend on the transversal conductibility of the intermediate collecting partitions 24.

Figure 3:
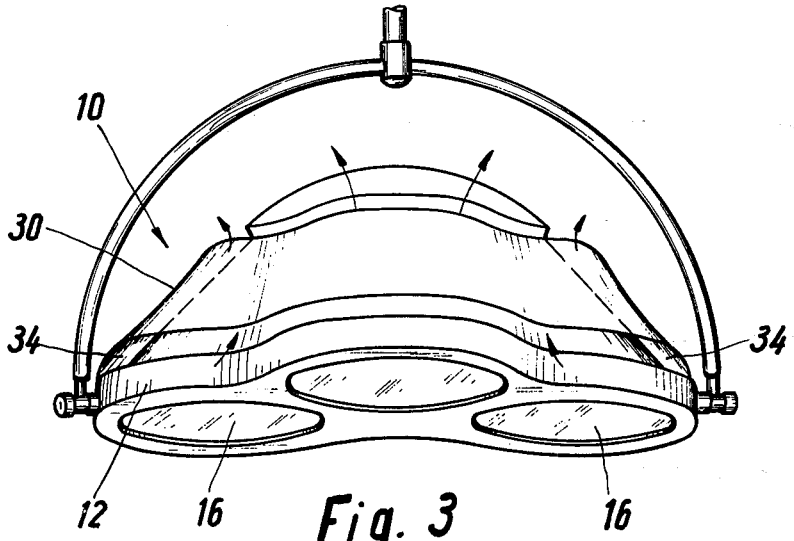
FIG. 3 is a perspective view of a surgical operating lamp according to the present invention with three radiation units.

Although FIG. 3 shows a surgical operating lamp with three radiation units obviously any number of radiation lights can be used in the case of the lighting arrangement according to the invention. Thereby, as the case may be, it can be favorable to dispense completely with the installation of intermediate collecting partitions, in order that the infrared radiation may reach the inner absorbing bell without hindrance. The main advantage of the invention consists in the fact that by means of a simple and inexpensive arrangement, a most effective chimney for the heat transfer and air circulation is obtained. Thereby, it is possible to increase the radiation effect of the surgical operating lamp considerably without the lamp heating itself to a considerable extent. It is simply as well as sturdily constructed and is independent from any supplementary means of connection.

What is claimed is:

1. In a suspended surgical lamp having a hollow annular lighting body including a transversely extending lower surface, a plurality of light sources within said lighting body facing said lower surface, said lighting body having transparent portions at positions aligned with respective light sources in its lower surface to allow passage of visible light from said sources, an individual first visible light reflector disposed about each of said light sources to reflect visible light rays towards said transparent portions of said lower surface and to transmit infrared radiation therethrough, second infrared reflectors which are transparent to visible light positioned between said light sources and said transparent portions to reflect infrared rays emanating from said light source away from said transparent portions, the improvement wherein said lighting body further comprises concentric inner and outer bell shaped members surrounding all of said light sources and facing said transverse lower surface, said inner bell shaped member being joined at its periphery to said annular lighting body to form with said transverse surface a closed chamber and absorbing infrared radiation from said first and second reflectors, said outer bell shaped member having upper and lower openings facing said inner bell shaped member and being spaced from said inner bell shaped member to form a chimney such that said lower opening allows air to enter between said inner and outer bell shaped members for convection flow upwardly therebetween by absorbing heat from said inner bell shaped member, for discharge from said upper opening to maintain said outer bell shaped member relatively cool.

2. The improved surgical operating lamp of claim 1 wherein said inner bell shaped member is opaque and black to absorb heat generated by said light sources.

3. The improved surgical operating lamp of claim 1 wherein said upper opening of said outer bell shaped member is circular about the central axis of said lamp.

4. The improved surgical operating lamp of claim 1 wherein said upper opening of said outer bell shaped member is annular.

5. The improved surgical operating lamp of claim 1 wherein said inner bell shaped member is attached to said transverse lower surface body by insulating attachment means to prevent heat transfer between said member and said lighting body.

6. The improved surgical operating lamp of claim 1 wherein said outer bell shaped member is attached to said inner bell shaped member by insulating attachment means to prevent heat transfer between said inner and outer members.

7. The improved surgical operating lamp of claim 1 wherein said first reflectors are parabolic in shape.

* * * * *